US005708905A

United States Patent [19]

Zangenfeind et al.

[11] Patent Number: 5,708,905

[45] Date of Patent: Jan. 13, 1998

[54] DEVICE FOR AUTOMATIC REMOVAL OF A PHOTOGRAPHIC FILM FROM A CARTRIDGE

[75] Inventors: Helmut Zangenfeind, Puchheim; Reinhart Wuerfel, Munich; H. Peter Mihm, Munich; Vasile Gherasoiu, Munich; Juergen Brunner, Munich, all of Germany

[73] Assignee: AGFA-Gevaert Aktiengesellschaft, Leverkusen, Germany

[21] Appl. No.: 731,562

[22] Filed: Oct. 16, 1996

[30] Foreign Application Priority Data

Oct. 25, 1995 [DE] Germany ..... 195 39 719.3

[51] Int. Cl.[6] ..... G03D 13/00

[52] U.S. Cl. ..... 396/598; 396/564; 396/612

[58] Field of Search ..... 396/512, 594, 396/598, 599, 600, 603, 612, 617, 620, 622, 636, 642, 930, 931, 934, 564

[56] References Cited

U.S. PATENT DOCUMENTS

| | | | |
|---|---|---|---|
| 4,557,425 | 12/1985 | Ichikawa | 396/612 |
| 4,731,628 | 3/1988 | Uenaka et al. | 396/612 |
| 4,831,401 | 5/1989 | Uchiyama et al. | 396/612 |
| 5,093,686 | 3/1992 | Shigaki . | |
| 5,229,802 | 7/1993 | Shiota et al. | 396/512 |
| 5,452,037 | 9/1995 | Blackman | 396/612 |
| 5,475,464 | 12/1995 | DeCook et al. | 396/620 |
| 5,541,699 | 7/1996 | Yamaguchi | 396/620 |

FOREIGN PATENT DOCUMENTS

| | | | |
|---|---|---|---|
| 0212134 | 3/1987 | European Pat. Off. . | |
| 516105 | 12/1992 | European Pat. Off. | G03D 13/00 |

*Primary Examiner*—A. A. Mathews

*Attorney, Agent, or Firm*—Furgang & Milde, LLP

[57] ABSTRACT

A device for automatic removal of a photographic film from a cartridge, in which the film is rolled up on a spool. The feed channel for the cartridge is disposed so that the cartridge moves through the channel by its own weight in the direction of its spool axis. The channel has a cross section that permits admission of the cartridge in only one direction. The device includes a mechanism to turn the cartridge into a position in which the spool axis is aligned horizontally. The devices also includes a mechanism for unwinding and separating the film from the spool in a light-impervious housing. A mechanism turns the empty cartridge so that its spool axis is vertical, with a prescribed orientation. A replaceable magazine sequentially collects and orders a plurality of empty cartridges.

20 Claims, 4 Drawing Sheets

DEVICE FOR AUTOMATIC REMOVAL OF A PHOTOGRAPHIC FILM FROM A CARTRIDGE

FIELD OF THE INVENTION

The invention relates to the field of devices for automatic removal of a photographic film from a cartridge, each having a longitudinal spool axis, and more particularly to devices for handling film cartridges in which a wound spool of film is placed, down a feed channel of the device that is oriented so that the cartridge moves through the channel in the direction of its longitudinal axis by its own weight, with the guide having a cross section that conforms to the shape of the cartridge, with a mechanism for turning the cartridge from a position in which the spool axis is aligned roughly vertically into a position with a horizontal spool axis.

BACKGROUND OF THE INVENTION

In processing photographic films in a large laboratory, the films are removed from the film cartridges in a so-called splicer and glued together into a long strip. In this case, the rear end of each film and the front end of the following film must be positioned at a splicing station in such a way that the ends can be joined by a splicing label. An example of a device of this type is described in, for example, EP-OS 212 134.

In devices of this known type, the film cartridges are destroyed in removing the film. The cartridge scraps are collected in a container and disposed of as waste.

In U.S. Pat. No. 5,093,686 a system is described in which the cartridges may be saved, and do not have to be destroyed when the film is initially removed for processing. Following developing and copying, the film is wound back into the cartridge and delivered to the customer with the finished prints of the pictures. As a result of this, the empty cartridges must be removed from the splicer and maintained in a defined order, so that later they can again be matched up with the individual films, for reinsertion.

SUMMARY OF THE INVENTION

Therefore, the present invention provides a relatively simple mechanism for automatic removal of a photographic film from a cartridge, which ensures that, after removal of the film, the cartridges can be forwarded in the same sequence as the films that go with them.

One embodiment according to the invention provides a device for handling a film cartridge in which a wound spool of film is placed, having a cartridge guide with a cross section conforming to the exterior profile of the cartridge, arranged so that the cartridge moves in the direction of its spool axis by its own weight, with a mechanism for turning the cartridge from a position in which the spool axis is aligned roughly vertically to a position in which the spool axis is aligned roughly horizontally, for removal of the film from the cartridge. The present invention therefore includes a mechanism for turning the spool axis of the cartridge from a horizontal to vertical orientation, feeding cartridges sequentially to a mechanism having a replaceable magazine, which holds a plurality of cartridges with their spool axis oriented vertically while maintaining their order.

By turning the cartridges into a vertical position after film removal, it is possible to bring them with no further propulsion in the defined orientation to a receiving magazine. There, the cartridges are collected in the same sequence in which the film was removed from them. In order to turn the cartridge from a horizontal to vertical position, it is advantageous to employ a flap surface onto which the cartridge is ejected after removal of the film. Subsequently the flap is pivoted into a position in which the cartridge can slide down by its own weight. The pivoting axis on one end of the flap is aligned horizontally and runs in the same direction in which the film is unwound from the cartridge. One embodiment of the invention provides a pneumatic cylinder for moving the from a position in which it forms a horizontal support surface for the cartridge into a position in which it functions as an inclined plane, allowing the cartridge to slide. Such a displaceable flap provides an inexpensive system for collecting empty cartridges.

To control the motion of the cartridge, the flap need not be moved into a vertical orientation, and therefore may be tipped only far enough so that the cartridge reliably begins to slide.

The displaceable flap is situated above a drop shaft, so that a cartridge lying on the flap in an inclined position will slide toward the drop shaft. This drop shaft thus admits the cartridges which slide down the flap surface. While the cartridge is sliding, the flap maintains a set orientation. Therefore, the drop shaft may be configured so that the cartridge maintains its axial alignment. The upper portion of the drop shaft is provided with a portion having the same inclination as that of the flap in its tilted orientation. A lower portion of the drop shaft is vertically oriented, with a gently curved bridging portion between the inclined upper portion and the vertical lower portion.

In order to eliminate malfunctions which might occur when a magazine is filled up with empty cartridges, it is advantageous to attach the magazine to the splicer system outside the darkroom. Therefore, an ejection mechanism is provided at the lower end of the drop shaft. This mechanism is so configured that the interior of the darkroom is protected from direct incident light at all times. In order to block light admittance, an opaque displaceable plate, having an aperture through which a cartridge can pass, is provided. The plate is preferably displaceable about a pivot so that a rotational movement is possible. During rotation of the plate, the cartridge must be maintained in an upright position. To maintain the cartridge in this upright, or vertically oriented position, a shaft-like receptacle is provided above the opening. This receptacle is shaped so that it can admit the cartridge only in a certain orientation about its vertical axis, and maintains this orientation. Using this rotary plate, the cartridge is moved to an ejection opening which is located under a covering or shroud. Normally this opening is closed by a cover plate. However, if the cartridge is located over the opening, then an opening in the cover plate is accessible, and the cartridge can fall into the magazine.

It is therefore an object according to the present invention to provide a device for handling a cartridge in which a wound spool of film is placed, with a guide for the cartridge arranged so that the cartridge moves in the direction of its spool axis by its own weight, with the guide having a cross section that conforms to the shape of the cartridge, with a mechanism for turning the cartridge spool axis from a horizontal to a vertical position, comprising a mechanism for turning the cartridge from a horizontally disposed spool axis to a vertically disposed spool axis for insertion into a replaceable magazine, in which several cartridges with a vertically aligned spool axis can be collected in orderly fashion.

It is also an object of the invention to provide a device in which the mechanism for turning the cartridge to a position with a vertically oriented spool axis includes a displaceable flap that is pivotally supported.

It is a further object of the invention to provide a device having a pivotally supported flap in which the pivoting axis is aligned horizontally and lies perpendicular to the spool axis.

It is another object of the invention to provide a device having a displaceable flap having a first position in which the flap is generally horizontal, stably supporting the cartridge, and a second position in which the flap is inclined, forming a sliding surface for the cartridge.

It is still another object of the invention to provide a device having a displaceable flap in which the flap displacement is activated by a pneumatic cylinder.

It is a still further object of the invention to provide a device having a displaceable flap, having a drop shaft situated below the flap, so that when the flap is displaced into an inclined position, the cartridge slides down into the drop shaft.

It is another object of the invention to provide a device having a drop shaft having a cross section conforming to the exterior shape of the cartridge.

It is another object of the invention to provide a device having a drop shaft which has an upper inclined portion, having a longitudinal axis generally parallel to an inclination angle of the flap, and a lower portion having a generally vertically oriented longitudinal axis.

It is also an object of the invention to provide a device having a mechanism to eject the cartridges from the housing, which substantially prevents the penetration of external light penetrating during ejection.

It is a further object of the invention to provide a device in which an ejection mechanism is placed beneath an enclosure, having a rotary table which rotates to an ejection opening, the rotary table having a shaft-like receptacle with a hollow base to retain the cartridge.

These and other objects and features of the present invention will become more fully apparent from the following description and appended claims taken in conjunction with the accompanying drawings, in which like numerals refer to like parts.

BRIEF DESCRIPTION OF THE DRAWINGS

The invention will now be described by way of the drawings, in which corresponding reference numerals indicate corresponding structures in the figures.

FIG. 1 shows a preferred embodiment of the invention, in which a clamping stamp 5 and a locking slide 4 are coupled to each other, so that they are moved together by a pneumatic cylinder 6. A leaf spring 7 is provided linking the locking slide 4 and the clamping stamp 5. The leaf spring 7 is pivotally supported by a housing by support 8, and rotates about this support 8. The shorter lever through an opening 2 of the upper housing cover 1 between two cams 3. These cams 3 are attached to a connecting rod 9 between the locking slide 4 and the pneumatic cylinder 6.

Figure 1A:
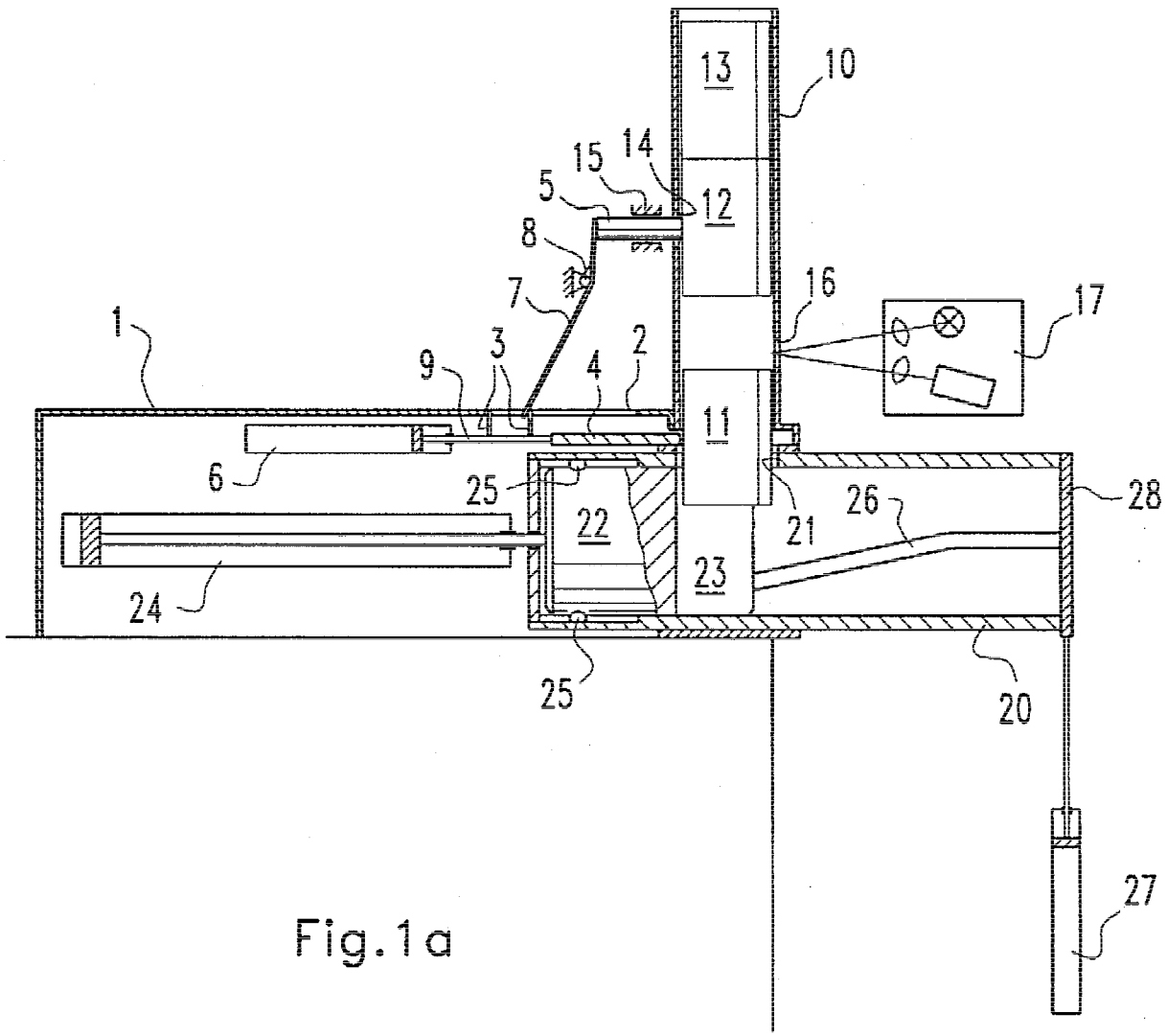
FIGS. 1*a*–1*c* show side cross sectional views of the mechanism according to the present invention, in the direction of cartridge transport, before setup for unwinding of the film from the spool, in three sequential conditions.
Figure 1B:
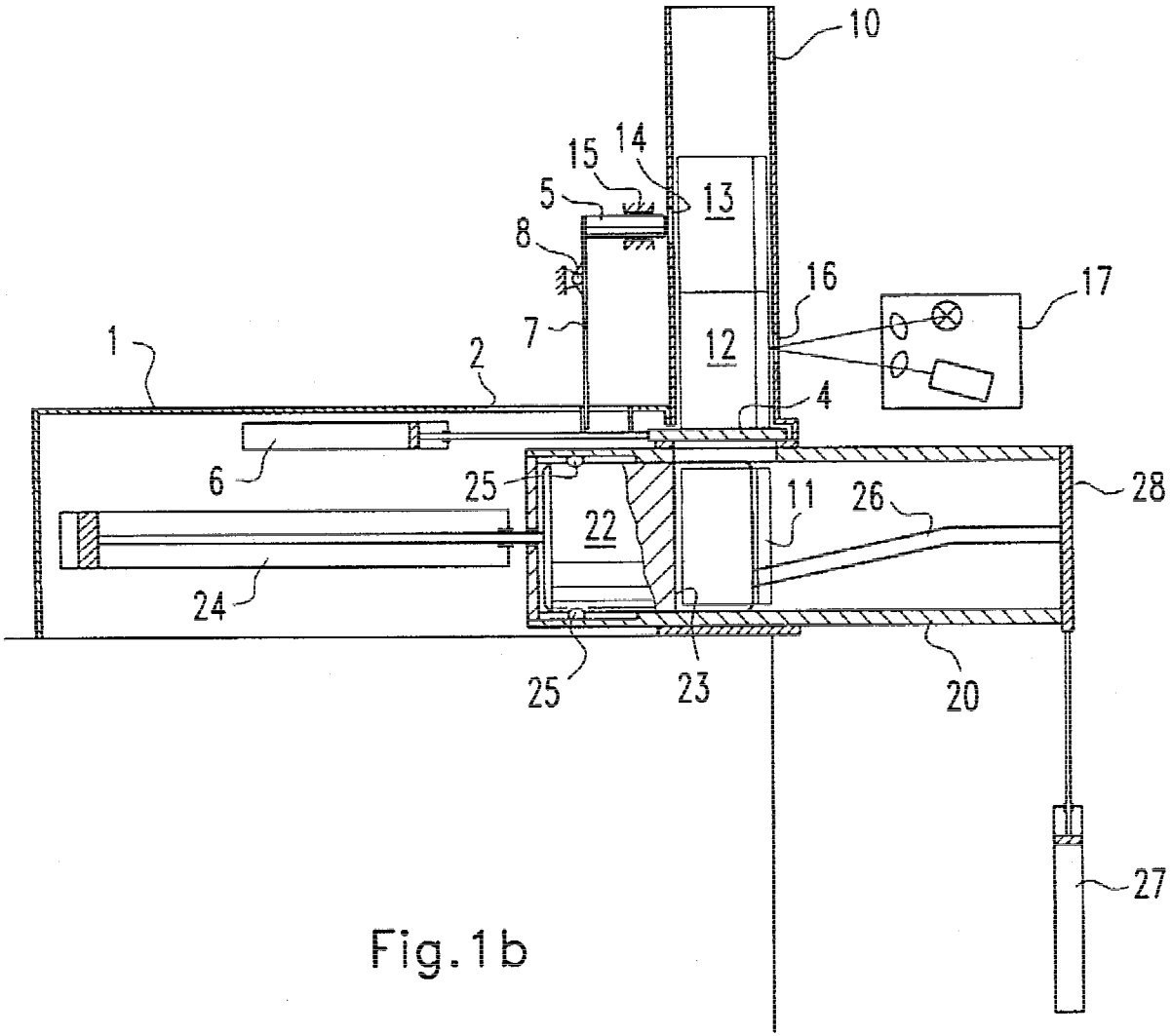
Figure 1C:
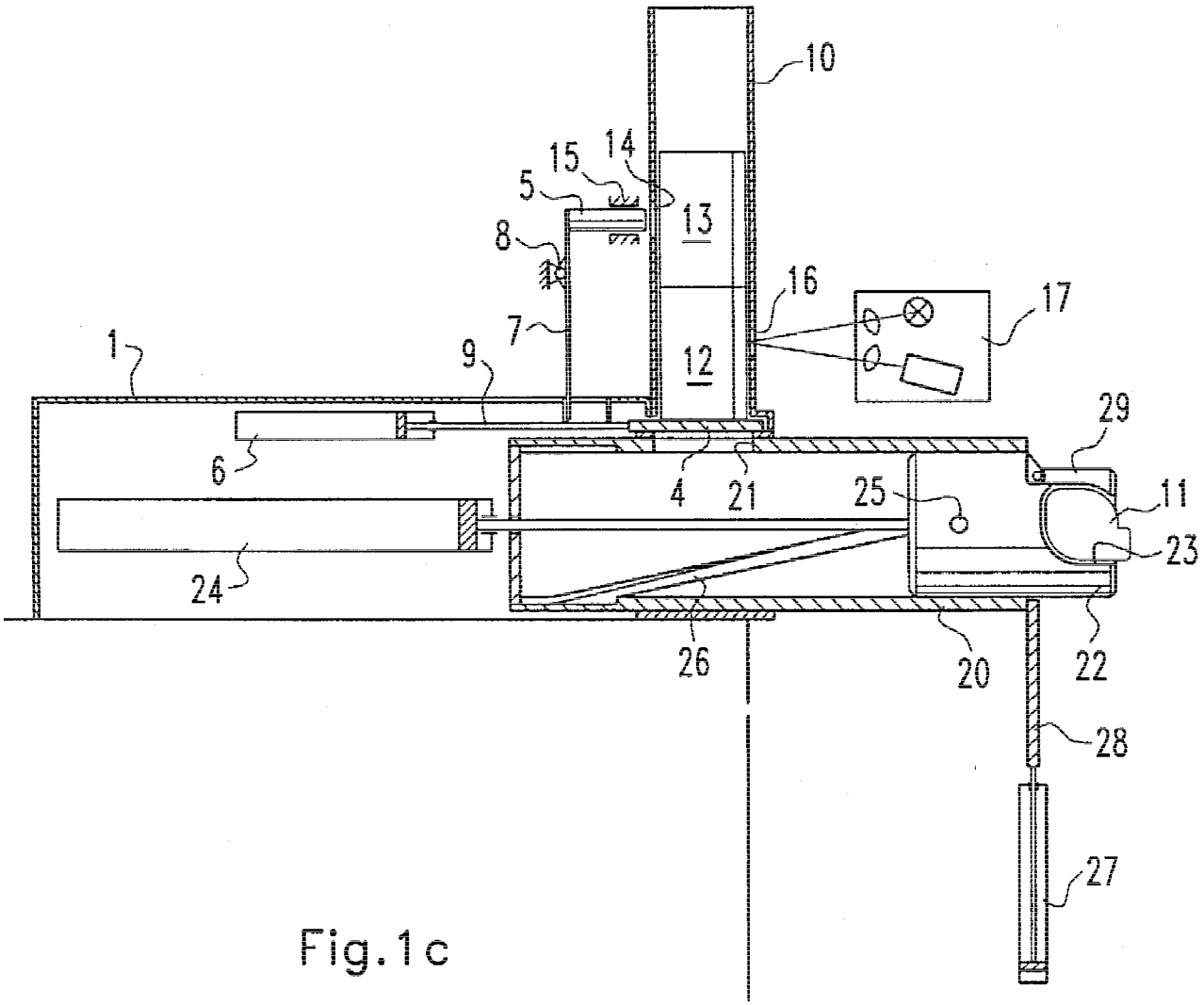

Film cartridges 11, 12, 13 are fed from a tube 10, whose shape conforms to the shape of the cartridges. This tube can be designed either as shown in FIGS. 1*a*, 1*b*, 1*c* having a fixed feed shaft, or as a replaceable magazine. In the latter case it would be advantageous to provide the tube at its lower end with an additional locking device, which is not shown. This prevents the cartridges from slipping out downwards when the replaceable magazine is inserted or mounted.

The tube 10 is provided with an opening 14, through which the clamping stamp 5, guided by friction bearing 15, can act on the cartridges to selectively allow advance downward. An additional opening 16 serves as the reading window for the scanner 17, to allow monitoring of the contents of the tube 10.

Beneath the locking slide 4, a cylindrical tube 20 is provided. This tube includes a feed opening 21 for cartridges 11, 12, 13. A cylindrically shaped sliding carriage 22, with a cartridge receiving chamber 23, is disposed in the tube 20. This sliding carriage 22 is rotatably linked to the piston rod of the pneumatic cylinder 24. Guiding pins 25 are provided within the tube 20 which are attached securely to the carriage, extending into the guide slots 26 of the tube 20.

As shown in the Figures, to keep light out of the interior of the device, the guide slots 26 are designed as partial thickness grooves in the tube's inner wall. In this manner, when the locking slide 4 is open, no light incident on the tube can get through guide slots 26 into the device's interior. However, such a component has high fabrication costs. Therefore, it is advantageous to have the guide slots 26 designed as slots running fully through the wall of the tube 20, which now no longer shuts out incident light. A closed exterior tube can then be placed over tube 20 to form a laminated wall tube, having the same functional properties but with reduced cost.

A slide 28, also activated by the pneumatic cylinder 27, is provided in the tube 20. When locking slide 4 is opened, this slide 28 also prevents incident light from coming through the guide shaft 10 into the interior of the device.

The receiving chamber 23 for film cartridges is formed by an appropriately shaped recess in carriage 22, and a flap 29, attached so as to swivel, as shown in FIG. 1*c*. It is advantageous to have this flap 29 be spring-loaded, so that the film cartridges are held clamped in the receiving chamber 23 in a pincers-like manner.

If a filled magazine is slipped on, or if feed shaft 10 is filled with cartridges, then the lowest cartridge 11 is sensed by the scanner 17. A check is performed of whether it contains a roll of film, which can be handled in the same way as the previous films, e.g., whether the film should be processed using the same steps in the same order. If this is the case, then pneumatic cylinder 6 is activated, opening the locking slide 4, while clamping stamp 5 is activated simultaneously by the cams 3 and leaf spring 7 in such a way that it compresses cartridge 12 against the opposite wall of feed shaft 10, thereby holding it securely by frictional forces. If locking slide 4 is completely open, the lowermost film cartridge 11 drops through the opening 21 of tube 20, into the cartridge receiving chamber 23 of carriage 22.

Locking slide 4 is again closed by means of the pneumatic cylinder 6. The clamping of cartridge 12 by clamping stamp 5 is released. This film cartridge and film cartridge 13 that lies above it slide downward in feed shaft 10, until the lower side of cartridge 12 rests on locking slide 4. This condition is depicted in FIG. 1*b*.

Locking slide 4 is shown in its closed position, preventing light from entering the interior of the device, in FIGS. 1*b* and 1*c*. Therefore, slide 28 can be opened via pneumatic cylinder 27.

Pneumatic cylinder 24, which acts in connection with carriage 22, is then activated. While the carriage moves through tube 20, the cartridge 11 in receiving chamber 23 not only moves in linear fashion, but is simultaneously turned by 90 degrees. This is achieved by the two guiding pins 25 that are attached to the carriage 22 and slide in the guide slots 26 of tube 20. One of the guide slots 26 begins in the manner depicted on the bottom of the left side of the tube 20 and continuously runs via the back side upwards to the middle of the tube 20. The second guide slot 26 begins correspondingly at the top of the left side of the tube 20, and runs via the front side of the tube, here cut off and not depicted, downwards, likewise approximately to the middle of the tube. Thus, the guide slots 26 form a helical cam. When carriage 22 is shifted forwards, the upper guiding pin 25 consequently moves forward out of the plane of the figures as depicted in FIG. 1*c*. The lower guiding pin 25 moves backward into the plane of the figures. In each case they move to the middle of the tube 20. In this way, simultaneous with linear movement of the carriage, and rotation by 90 degrees is achieved.

The final position of carriage 22 is depicted in FIG. 1*c*. The film cartridge here is in its position for removal.

The cartridge is held in this position by a mechanism that is not shown in the figures. While this occurring, carriage 22 can again be drawn back by action of pneumatic cylinder 24 into its initial position, shown in FIG. 1*a*. While this is taking place, flap 29 is opened briefly. However, it is again moved back into its closed position when the carriage has moved far enough so that the cartridge is outside receiving chamber 23. As soon as the carriage is back in its initial position, slide 28 is closed by the action of pneumatic cylinder 27. This ensures stray light will not enter the film removal point when locking slide 4 is again opened. Likewise, a mechanism (not described here in detail) is provided that holds flap 29 in this initial position of the carriage, to allow the cartridge to fall into the receiving chamber 23, and subsequently be clamped by the spring loaded flap 29. As a result of these actions, the device again is in the condition shown in FIG. 1*a*, so that the next cartridge can be fed.

The cartridge is fed to a supporting surface of a flap 31, which may be pivoted about pivot 39 to an inclined position. In the inclined position, the cartridge slides downward. Beneath the flap 31, a drop shaft 30 is provided, into which the empty cartridges slide.

The drop shaft 30 is curved, so that cartridges sliding downward are gradually brought to a vertical position. Thus, an upper portion of the drop shaft 30 is inclined while a lower portion of the drop shaft 30 is vertically oriented. The vertically oriented lower portion of drop shaft 30 ends in opening 48 of a covering 40. This covering 40 is placed over the entire cartridge ejection device. It prevents penetration of light that may be incident during cartridge ejection into the film removal point.

The housing base 46 is provided with an ejection opening 47. On this housing base 46, a rotary table 42 is mounted which pivots about rotational axis 43. An extension 44 forms a two-armed lever with rotary table 42 through rotational axis 43. This extension 44 can be pivoted by means of a pneumatic cylinder (not shown here) which fastens to bolt 45. The rotary table includes an opening 51 that conforms to the shape of the film cartridges. Together with the open channel section 41, this opening 51 forms an receiving chamber or receptacle for the cartridges. A slot 49 in channel section 41 guides the cartridge mouth 52 in such a way that each cartridge is in a prescribed position. Drop shaft 30 also has a cross section which conforms to the shape of the cartridges.

Figure 2:
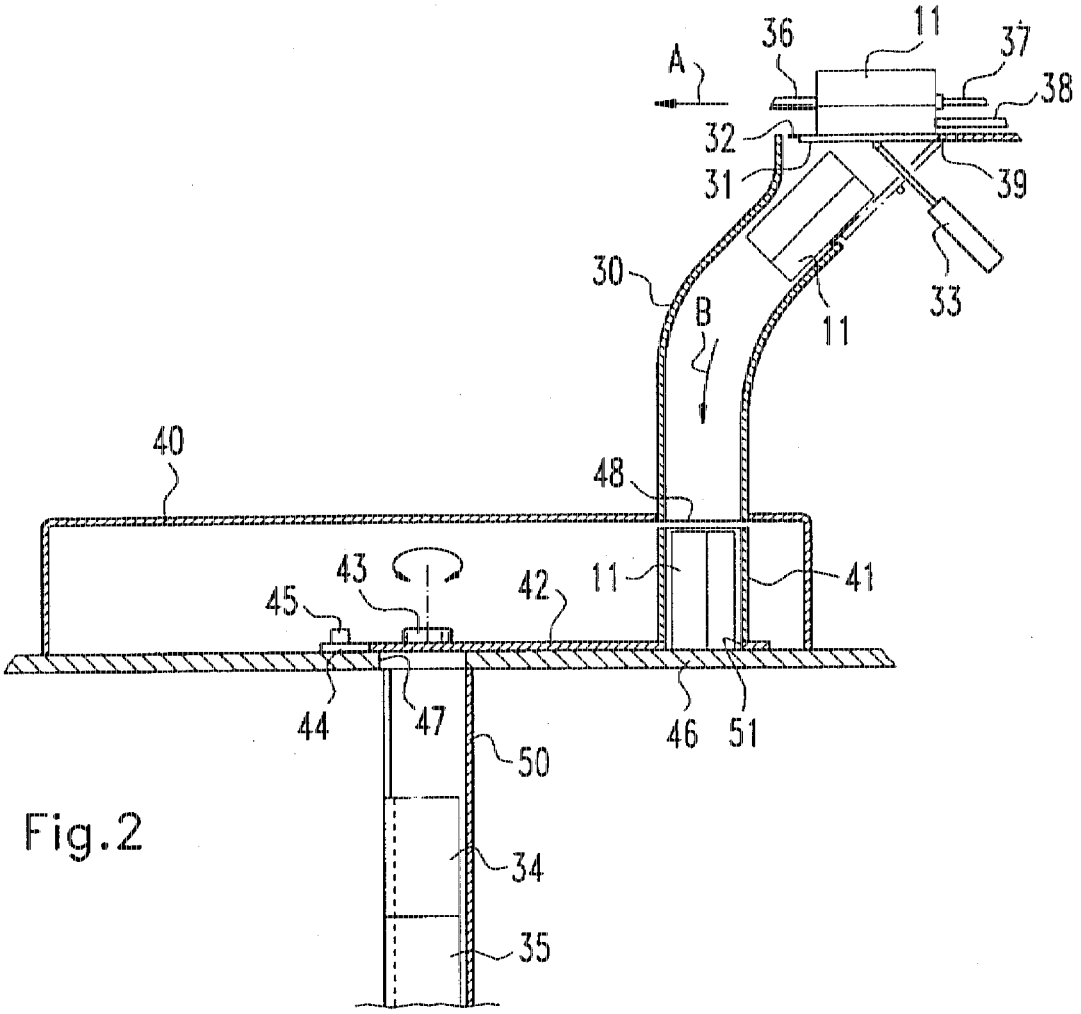
FIG. 2 shows a side cross sectional view of the mechanism according to the present invention in the direction of cartridge transport, following setup for unwinding the film from the spool, cut along the line II—II in FIG. 3.

As shown in FIG. 2, a magazine 50 is attached beneath ejection opening 47. This can be designed exactly the same as a magazine 10 that possibly is used when inserting the cartridges.

If the cartridge is then in the position shown in FIG. 1*c*, then the shaft 36, as shown in FIG. 2, is inserted opposite to the direction of arrow A, and cartridge 11 is thus held between shafts 36, 37. The carriage 22 is withdrawn to the position shown in FIG. 1. The film is unwound from the cartridge and detached from the cartridge. This process is shown in EP-OS 0 636 924.

As soon as the cartridge has been emptied, shaft 36 is pulled back in the direction of arrow A. A ram 38 is activated to push the cartridge 11 so that it is withdrawn from shaft 37. The cartridge 11 now rests only on flap 31. The flap 31 is then brought into the position indicated by dots and dashes in FIG. 2 by the action of pneumatic cylinder 33, so that cartridge 11 slides into drop shaft 30. This dropping motion is indicated by arrow B.

Figure 3:
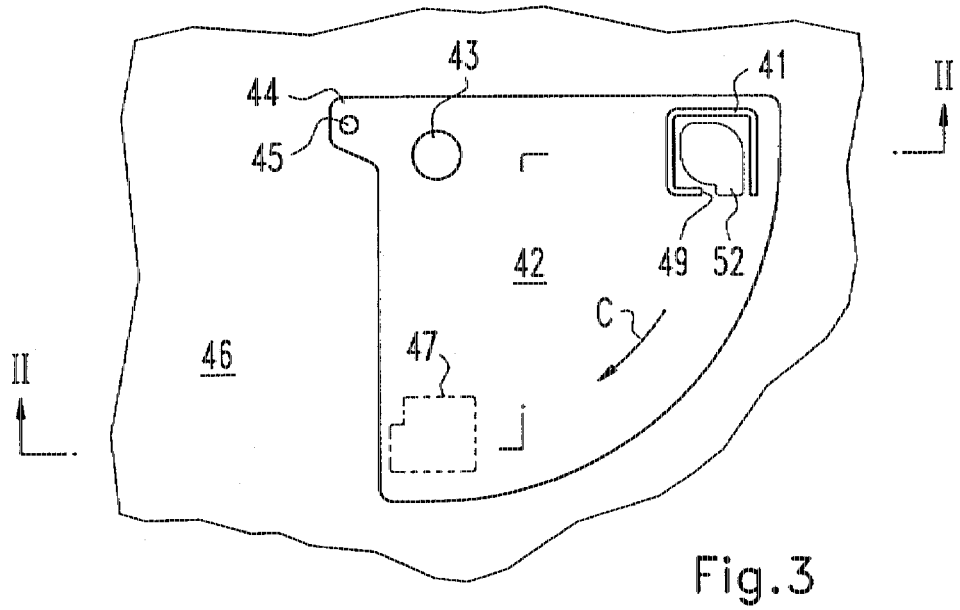
FIG. 3 shows a top view of cartridge ejector mechanism according to the present invention, below an upper covering.

In its next traced position, cartridge 11 is in a vertical orientation, in the receiving chamber formed by opening 51 of rotary table 43 and channel section 41. After the cartridge 11 is in the vertical orientation, in the receiving chamber, the rotary table 42 pivots in the direction of arrow C, shown in FIG. 3. The cartridge 11 slides on its lower end on the housing covering 46. When the opening 51 is aligned with the ejection opening 47, the cartridge 11 slides down through ejection opening 47, into magazine 50. FIG. 2 shows empty cartridges 34, 35 already in the magazine 50. The cartridges in magazine 50 are held in a predetermined sequence and an orderly alignment, and therefore may be rejoined with the appropriate processed film in a later operation.

To ensure safe and appropriate functioning of the device, several sensing devices (not depicted here) are arrayed which check the particular conditions and generate messages in the event of possible errors. These sensing devices communicate with a control device which controls the system and generates appropriate messages in the event of any malfunctions.

While the above detailed description has shown, described and pointed out the fundamental novel features of the invention as applied to various embodiments, it will be understood that various omissions and substitutions and changes in the form and details of the device illustrated may be made by those skilled in the art, without departing from the spirit of the invention. Consequently, the full scope of the invention should be ascertained by the appended claims.

What is claimed is:

1. A device for handling a cartridge having a wound spool of film therewithin having a spool axis, the device having a guide arranged for guiding the cartridge in a direction of its spool axis by its own weight, with the guide having a cross section that conforms to a shape of the cartridge, the device further having a first mechanism for turning the cartridge from a position in which the spool axis is aligned approximately vertically into a position in which the spool axis is aligned approximately horizontally, the device further comprising a second mechanism for turning the cartridge from the position in which the spool axis is aligned approximately horizontally to a position in which the spool axis is aligned approximately vertically, said second turning mechanism comprising a replaceable magazine, adapted for receiving and maintaining in order of receipt a plurality of cartridges, each having an approximately vertically aligned spool axis.

2. The device according to claim 1, wherein said second turning mechanism comprises a pivotally supported flap.

3. The device according to claim 2, wherein said pivotally supported flap has a horizontally aligned pivot axis which is disposed approximately perpendicular to the spool axis of a cartridge having an approximately horizontally aligned spool axis.

4. The device according to claim 3, wherein said pivotally supported flap comprises a surface, being displaceable between a first approximately horizontal position wherein said surface supports the cartridge and a second inclined position wherein a cartridge may slide on the surface.

5. The device according to claim 4, further comprising a pneumatic cylinder for displacing said flap.

6. The device according to claim 4, further comprising a drop shaft disposed beneath said flap, arranged so that a cartridge may slide down said surface into said drop shaft from said inclined flap.

7. The device according to claim 6, wherein said drop shaft comprises an opening having a cross section that conforms to a shape of the cartridge.

8. The device according to claim 6, wherein said drop shaft comprises two sections, an upper section having a longitudinal axis running parallel to said inclined flap, and a lower section having a longitudinal axis running vertically.

9. The device according to claim 1, further comprising an ejection mechanism having a housing, for receiving cartridges from said drop shaft and ejecting cartridges from said housing, said ejection mechanism and housing being so configured to prevent light from penetrating into said drop shaft during ejection of a cartridge.

10. The device according to claim 9, wherein said ejection mechanism comprises a cover and an ejection opening, said ejection mechanism being disposed beneath said cover, said ejection mechanism comprising a rotary table, having a hollow recess for admission of a cartridge from said drop shaft while said rotary table is in a first position, said rotary table being rotatable to a second position aligned with said ejection opening for ejection of the cartridge therethrough.

11. A device for handling a film cartridge having a film spool axis, having a gravitational feed for feeding cartridges substantially parallel to the spool axis in a channel corresponding to an exterior shape of the cartridge, and subsequently being reoriented so that the spool axis is disposed substantially horizontally, comprising:

a mechanism for reorienting the film cartridge from the position in which the spool axis is disposed substantially horizontally to an orientation in which the spool axis is disposed generally vertically; and a replaceable magazine for sequentially collecting a plurality of film cartridges and maintaining a sequence thereof.

12. The device according to claim 11, wherein said mechanism for reorienting the film cartridge comprises a pivotable flap.

13. The device according to claim 12, wherein said pivotable flap comprises a horizontally disposed pivoting axis, said pivoting axis being substantially perpendicular to said spool axis in said substantially vertical position.

14. The device according to claim 13, wherein said flap is pivotable between a substantially horizontal position to an inclined position, having a surface on which the cartridge slides in said inclined position.

15. The device according to claim 14, further comprising a pneumatic cylinder for pivoting said flap.

16. The device according to claim 14, further comprising a drop shaft below said flap, positioned such that the cartridge slides down into said drop shaft when said flap is inclined.

17. The device according to claim 16, wherein said drop shaft has a cross section corresponding to the exterior shape of the cartridge.

18. The device according to claim 16, wherein said drop shaft comprises two portions, an upper portion having a longitudinal axis having an inclination corresponding to an inclination of said flap, and a lower portion having a substantially vertical longitudinal axis.

19. The device according to claim 11, further comprising an ejection mechanism to eject the cartridges after reorienting, said ejection mechanism shielding the device from the penetration of light during ejection.

20. The device according to claim 19, wherein said ejection mechanism comprises a housing, and a pivotally mounted plate within said housing, having a first position in which a cartridge enters a receptacle, and a second position, pivoted with respect to said fist position, in which the cartridge is aligned with an ejection opening in said housing.

* * * * *